US010486177B2

(12) United States Patent
Park et al.

(10) Patent No.: US 10,486,177 B2
(45) Date of Patent: Nov. 26, 2019

(54) SPRAY STRUCTURE FOR PORTABLE ATOMIZER

(71) Applicant: TONGIL POCKET CASE CO., LTD, Incheon (KR)

(72) Inventors: Nam Joo Park, Siheung-si (KR); Jae Sang Park, Siheung-si (KR)

(73) Assignee: Tongil Pocket Case Co., Ltd., Incheon (KR)

( * ) Notice: Subject to any disclaimer, the term of this patent is extended or adjusted under 35 U.S.C. 154(b) by 0 days.

(21) Appl. No.: 16/101,202

(22) Filed: Aug. 10, 2018

(65) Prior Publication Data

US 2019/0210048 A1 Jul. 11, 2019

(30) Foreign Application Priority Data

Jan. 11, 2018 (KR) ..... 10-2018-0003975

(51) Int. Cl.

| | |
|---|---|
| ***B05B 17/00*** | (2006.01) |
| ***B05B 9/04*** | (2006.01) |
| ***A45D 34/00*** | (2006.01) |
| ***B05B 11/00*** | (2006.01) |

(52) U.S. Cl.

CPC ..... *B05B 9/0416* (2013.01); *A45D 34/00* (2013.01); *B05B 11/0032* (2013.01); *A45D 2200/056* (2013.01); *B05B 11/3057* (2013.01)

(58) Field of Classification Search

CPC ..... B05B 9/0416; B05B 11/0032; B05B 11/3057; A45D 34/00; A45D 2200/056

See application file for complete search history.

(56) References Cited

U.S. PATENT DOCUMENTS 3,245,588 A * 4/1966 Sagarin ..... B65D 83/205 222/182
3,469,746 A * 9/1969 Melocchi ..... B65D 83/206 222/182
3,510,029 A * 5/1970 Doyle ..... B65D 83/206 222/402.12

(Continued)

FOREIGN PATENT DOCUMENTS

JP 2525513 11/1996
JP 2003054668 2/2003

(Continued)

OTHER PUBLICATIONS

Korean Intellectual Property Office, Office Action, dated Mar. 14, 2018, issued in Korea Patent Application No. KR 10-2018-000395.

(Continued)

*Primary Examiner* — Frederick C Nicolas
(74) *Attorney, Agent, or Firm* — Klarquist Sparkman, LLP

(57) ABSTRACT

A spray structure for a portable atomizer includes: a case including an opening; a cover exposed through the opening of the case; a head portion placed in the case and coupled to the cover, the head portion including a discharge hole; and an elastic portion between the head portion and the cover, wherein the cover is configured to be rotated on a first axis by a first angle above the head portion to expose the discharge hole through the opening of the case and to be linearly moved in a second direction perpendicular to the first axis in a state in which the discharge hole is exposed.

5 Claims, 17 Drawing Sheets

(56) References Cited

U.S. PATENT DOCUMENTS

| | | | | |
|---|---|---|---|---|
| 3,680,738 | A * | 8/1972 | Vos | B65D 83/207 222/136 |
| 5,205,424 | A * | 4/1993 | Gaspar | B65D 50/067 215/210 |
| 6,349,855 | B1 * | 2/2002 | Borri | A45D 34/02 222/182 |
| 6,796,464 | B1 * | 9/2004 | Tung | B65D 47/305 222/402.13 |
| 6,908,017 | B2 * | 6/2005 | Mineau | B65D 83/205 222/148 |
| 8,240,523 | B2 * | 8/2012 | Goulet | B65D 83/40 222/182 |

FOREIGN PATENT DOCUMENTS

| | | |
|---|---|---|
| JP | 4278878 | 6/2009 |
| KR | 200383523 | 5/2005 |
| KR | 10-1458314 B1 | 11/2014 |
| KR | 101458314 | 11/2014 |

OTHER PUBLICATIONS

Korean Intellectual Property Office, Notice of Allowance, dated Jun. 25, 2018, issued in Korea Patent Application No. KR 10-2018-000395.

International Search Report for PCT/KR2018/015768, dated Mar. 11, 2019.

* cited by examiner

SPRAY STRUCTURE FOR PORTABLE ATOMIZER

CROSS-REFERENCE TO RELATED APPLICATION

This application claims the benefit of Korean Patent Application No. 10-2018-0003975, filed on Jan. 11, 2018, in the Korean Intellectual Property Office, the disclosure of which is incorporated herein in its entirety by reference.

BACKGROUND

1. Field

One or more embodiments relate to a spray structure for a portable atomizer, and more particularly, to a spray structure for a pressurizing-type atomizer.

2. Description of the Related Art

Substances such as cosmetics are contained in various containers. Among such containers, a pressuring-type pumping container configured to discharge a substance contained therein to the outside by a pressurizing method may have a discharge hole exposed to the outside or provided with an additional protective cap.

SUMMARY

According to one or more embodiments, a spray structure for a portable atomizer includes: a case including an opening; a cover exposed through the opening of the case; a head portion placed in the case and coupled to the cover, the head portion including a discharge hole; and an elastic portion between the head portion and the cover, wherein the cover is configured to be rotatable about on a first axis by a first angle above the head portion to expose the discharge hole through the opening of the case and to be linearly moved in a second direction perpendicular to the first axis in a state in which the discharge hole is exposed.

In an embodiment, the spray structure may further include a connection cap configured to cover a first end portion of the elastic portion at a position between the head portion and the cover.

In an embodiment, when the cover is rotated by the first angle, a second end portion of the elastic portion may provide force to the cover through an opening of the connection cap.

In an embodiment, the spray structure may further include an assembly of a protrusion and a groove that are provided between the head portion and the case and moving relative to each other while being engaged with each other.

In an embodiment, the elastic portion may include a flat spring.

In an embodiment, the spray structure may further include a stoppage portion provided on an inner side of the case and accommodating a portion of the cover.

According to one or more embodiments, a spray structure for a portable atomizer includes: a case including an opening; a head portion placed in the case and including a discharge hole; and a cover exposed in a state in which the cover is coupled to an upper portion of the head portion, wherein the cover is configured to be rotatable around a first axis from a first position at which the cover covers the opening to expose the discharge hole at a second position, and configured to press the head portion while being linearly moved from the second position in a direction perpendicular to the first axis.

In an embodiment, the case may further include a rib provided around the opening and defining a space of the opening occupied by the cover at the second position as a T-shaped opening, and the cover is configured to be linearly moved through the T-shaped opening.

In an embodiment, the cover may include a first portion and a second portion extending in a direction crossing the first portion, and when the cover is linearly moved, the first portion may be moved between an inner side of the opening and the rib.

In an embodiment, the rib may include a stoppage portion configured to control separation of the cover at the second position.

In an embodiment, the spray structure may further include a connection cap between an upper end of the head portion and the cover, wherein one of the connection cap and the cover may include a protrusion, and the other of the connection cap and the cover may include a groove configured to accommodate the protrusion.

In an embodiment, the spray structure may further include an elastic portion configured to provide elastic force to the cover when the cover is rotated from the first position to the second position, and the position of the elastic portion on the upper end of the head portion may be regulated by the connection cap.

Other aspects and characteristics will become apparent and more readily appreciated from the accompanying drawings, claims, and detailed description.

BRIEF DESCRIPTION OF THE DRAWINGS

These and/or other aspects will become apparent and more readily appreciated from the following description of the embodiments, taken in conjunction with the accompanying drawings in which.

DETAILED DESCRIPTION

Figure 1:
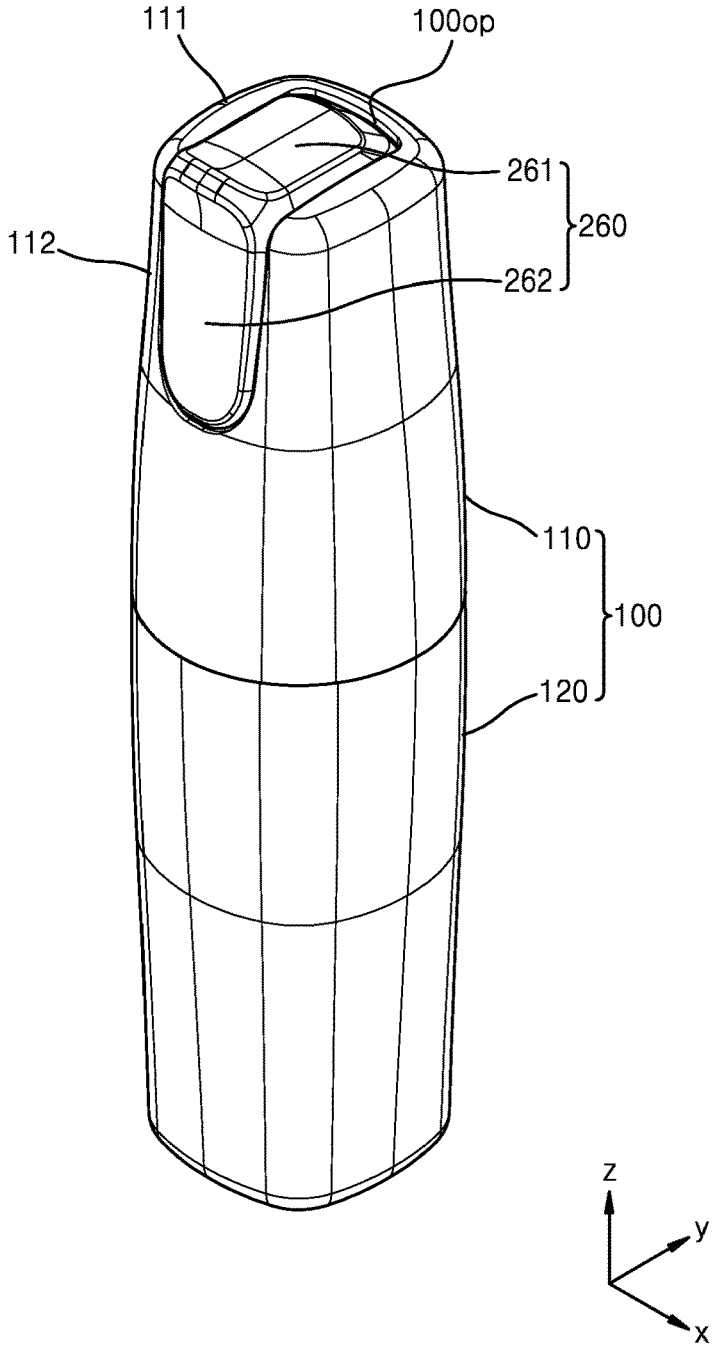
FIG. 1 is a perspective view illustrating a spray structure for a portable atomizer according to an embodiment of the present disclosure.

Reference will now be made in detail to embodiments, examples of which are illustrated in the accompanying drawings. In this regard, the present embodiments may have different forms and should not be construed as being limited to the descriptions set forth herein. Accordingly, the embodiments are merely described below, by referring to the figures, to explain aspects of the present description. As used herein, the term "and/or" includes any and all combinations of one or more of the associated listed items.

Hereinafter, the embodiments will be described with reference to the accompanying drawings. In the drawings, like reference numerals denote like elements, and overlapping descriptions thereof will be omitted.

In the following descriptions of the embodiments, although the terms "first" and "second" are used to describe various elements, these elements should not be limited by these terms. These terms are only used to distinguish one element from another element.

In the following descriptions of the embodiments, the terms of a singular form may include plural forms unless referred to the contrary.

In the following descriptions of the embodiments, the meaning of "include," "comprise," "including," or "comprising" specifies a property or an element, but does not exclude other properties or elements.

It will be understood that when a region or an element is referred to as being "above" or "on" another region or element, it can be directly on the other region or element, or intervening regions or elements may also be present.

In the drawings, the sizes of elements may be exaggerated for clarity. For example, in the drawings, the size or thickness of each element may be arbitrarily shown for illustrative purposes, and thus the inventive concept should not be construed as being limited thereto.

The order of processes explained in one embodiment may be changed in a modification of the embodiment or another embodiment. For example, two processes sequentially explained may be performed substantially at the same time or in the reverse of the explained order.

It will be understood that when a region, an element, or the like is referred to as being "connected to," another region or element, it can be directly or indirectly connected to the other region or element. That is, for example, intervening regions or elements may be present. For example, in the present disclosure, when a region, an element, or the like is referred to as being "mechanically connected to," another region or element, it can be directly or indirectly mechanically connected to the other region or element. That is, for instance, intervening regions or elements may be present.

FIG. 1 is a perspective view illustrating a spray structure for a portable atomizer according to an embodiment of the present disclosure.

Figure 2:
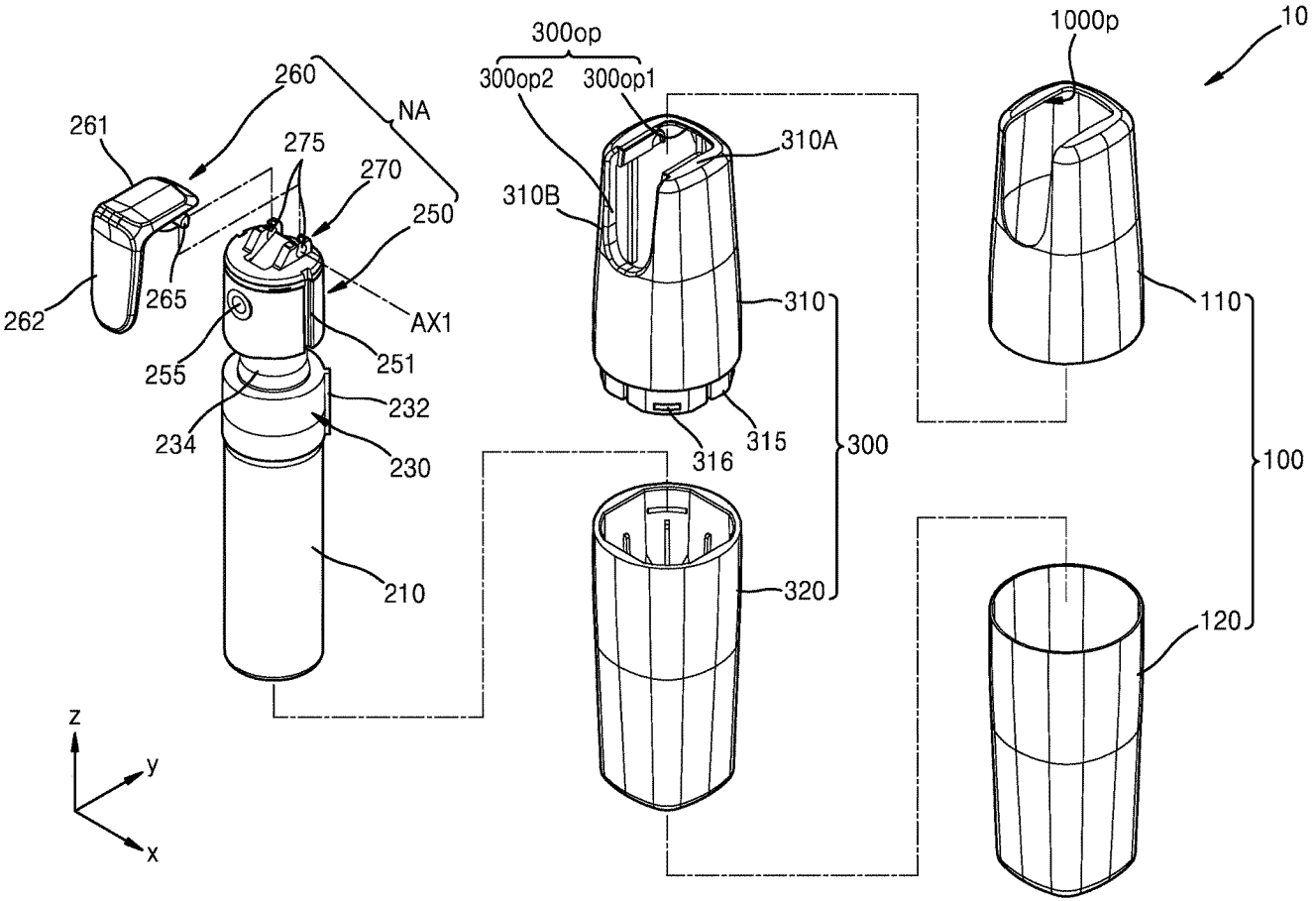
FIG. 2 is an exploded perspective view illustrating the spray structure shown in FIG. 1.

Referring to FIGS. 1 and 2, the spray structure 10 includes a cover 260. The cover 260 may be provided on an upper side of an outer casing member 100. The outer casing member 100 may include an upper outer casing member 110 and a lower outer casing member 120, and the upper outer casing member 110 may include an opening 100*op* corresponding to the cover 260. The outer casing member 100 may include a metallic material such as aluminum or an insulative material such as a plastic material.

The cover 260 may have a shape bent along an upper portion of the outer casing member 100. For example, the cover 260 includes a first portion 261 and a second portion 262 connected to an end portion of the first portion 261 and extending in a direction crossing the first portion 261. The first portion 261 corresponds to an upper surface 111 of the outer casing member 100, and the second portion 262 corresponds to a lateral surface 112 connected to the upper surface 111.

The cover 260 may cover the opening 100*op* and may be rotatable around a given axis to an open state, for example, by a user's hand touch. In the open state, the cover 260 is linearly movable in a vertical direction (z-axis direction), and as the cover 260 is linearly moved, content contained in the spray structure 10 may be discharged to the outside.

The spray structure 10 of the embodiment may be configured as illustrated in FIG. 2.

Referring to FIG. 2, the spray structure 10 may include an internal storage portion 210. The storage portion 210 may have a cylindrical shape with an opened upper side, and a substance may be accommodated and stored in the storage portion 210. The content contained in the storage portion 210 may be a substance that may spout out of the storage portion 210, such as cosmetics, deodorants, deodorizers, air fresheners, oral cleansers, or cleansers, but is not limited thereto. The content may be liquid or gas. If the content is liquid, the content may have a given viscosity (for example, from 0.001 poise to 0.6 poise, etc.) or may not have viscosity.

The storage portion 210 is connected to a pumping portion 230 providing pressure for discharging the content contained in the storage portion 210 to the outside. The pumping portion 230 may provide pressure for discharging the content according to a pumping action of a head portion 250 such as a vertical linear movement of the head portion 250. A protrusion 232 may be provided on an outer surface of the pumping portion 230, and the protrusion 232 may be coupled to a groove formed in an inner side of a case 300.

The head portion 250 includes a discharge hole 255. The discharge hole 255 may be provided in a lateral surface of the head portion 250. The content of the storage portion 210 may be discharged to the outside through the discharge hole 255 after passing through a tube 234 of the pumping portion 230.

The cover 260 is placed on the head portion 250 and is mechanically connected to the head portion 250. For example, the cover 260 may be mechanically connected to the head portion 250 through a connection cap 270. In an embodiment, the cover 260 includes a pair of protrusions 265 protruding from both sides thereof in parallel to an x-axis direction, and the protrusions 265 may be coupled to a pair of grooves 275 of the connection cap 270 in the x-axis direction parallel to a first axis AX1. In a state in which the protrusions 265 are coupled to (engaged with) the grooves 275, when force is applied to turn the cover 260, the cover 260 may be rotated by a first angle as the protrusions 265 coupled to the grooves 275 are rotated around the first axis AX1.

As described above, elements such as the head portion 250 and the cover 260 are mechanically connected to each other via the connection cap 270, and structures including the head portion 250 and the cover 260 mechanically connected to each other will now be collectively referred to as a cover assembly NA.

The cover assembly NA is placed inside the case 300, and the cover 260 may be exposed to the outside through an opening 300*op* of the case 300. For example, elements such as the storage portion 210, the pumping portion 230, the head portion 250, and the connection cap 270 connecting the head portion 250 and the cover 260 may be placed inside the case 300. The cover 260 may be exposed to the outside through the opening 300*op* provided in the case 300.

The opening 300*op* is provided in an upper portion of the case 300, and the case 300 may include an upper case 310 and a lower case 320 configured to be coupled to each other. One of the upper case 310 and the lower case 320, for example the upper case 310, includes a skirt portion 315 extending toward the lower case 320, and the upper case 310 and the lower case 320 may be coupled to each other using a protrusion 316 provided on an outer surface of the skirt portion 315.

The opening 300*op* has a shape corresponding to the cover 260. For example, the opening 300*op* may include a first opening region 300*op*1 provided in an upper surface 310A of the upper case 310 and a second opening region 300*op*2 provided in a lateral surface 310B connected to the upper surface 310A, and the first opening region 300*op*1 and the second opening region 300*op*2 are connected to each other as one opening region. The opening 300*op* has a shape corresponding to the cover 260 in such a manner that the first opening region 300*op*1 of the opening 300*op* corresponds to the first portion 261 of the cover 260, and the second opening region 300*op*2 of the opening 300*op* corresponds to the second portion 262 of the cover 260. The cover 260 may cover the opening 300*op* and may be exposed to the outside through the opening 300*op*.

The cover 260 covering the opening 300*op* of the case 300 may be rotated around the first axis AX1 to the open state, for example, by a user's hand motion, and as the cover 260 is opened, the discharge hole 255 spatially isolated from the outside by the cover 260 is exposed through the opening 300*op*, for example, through the second opening region 300*op*2 and may thus be spatially connected to the outside.

Referring to FIG. 2, elements such as the storage portion 210 and the head portion 250 are placed inside the case 300, and the case 300 is placed inside the outer casing member 100. In this case, the opening 300*op* of the case 300 may correspond to the opening 100*op* (refer to FIG. 1) of the outer casing member 100. For example, the opening 300*op* of the case 300 and the opening 100*op* of the outer casing member 100 may be superposed on each other and may have substantially the same size. Since the opening 300*op* of the case 300 corresponds to the opening 100*op* of the outer casing member 100, the cover 260 may be exposed through the opening 300*op* of the case 300 and the opening 100*op* of the outer casing member 100, and as the cover 260 is rotated, the discharge hole 255 may be exposed to the outside.

Protrusions 313 (refer to FIG. 5) corresponding to grooves 251 formed in an outer surface of the head portion 250 may be provided on an inner surface of the case 300. The grooves 251 may be linearly extended in a direction parallel to a movement direction (z-axis direction) of the head portion 250, and the protrusions 313 may have a shape corresponding to the grooves 251. Since the cover assembly NA moves linearly as described later in a state in which the protrusions 313 provided on the inner surface of the case 300 are inserted in the grooves 251 of the head portion 250, idle rotation of the cover assembly NA is prevented, thereby preventing the content from being discharged in directions other than a direction toward the opening 300*op* of the upper case 310 and the spray structure 10 from being mechanically damaged as the cover 260 is separated from the opening 300*op* or is broken. As described above, the grooves 251 and the protrusions 313 may be provided between the head portion 250 and the case 300 in a vertically long shape as an assembly of protrusions and grooves engaging with each other and movable relative to each other. In some cases, the grooves 251 and the protrusions 313 may be reversely provided. That is, for example, the protrusions 313 may be provided on the outer surface of the head portion 250, and the grooves 251 may be provided in the inner surface of the case 300.

Referring to FIG. 2, elements such as the storage portion 210 and the head portion 250 are placed inside the case 300, and the case 300 is placed inside the outer casing member 100. However, this is a non-limiting embodiment. In another embodiment, the case 300 and the outer casing member 100 may be provided integrally or in one piece, or only one of the case 300 and the outer casing member 100 may be used. The case 300 may function as an outer casing material, and in this case, the outer casing member 100 shown in FIG. 2 may be omitted.

Figure 3:
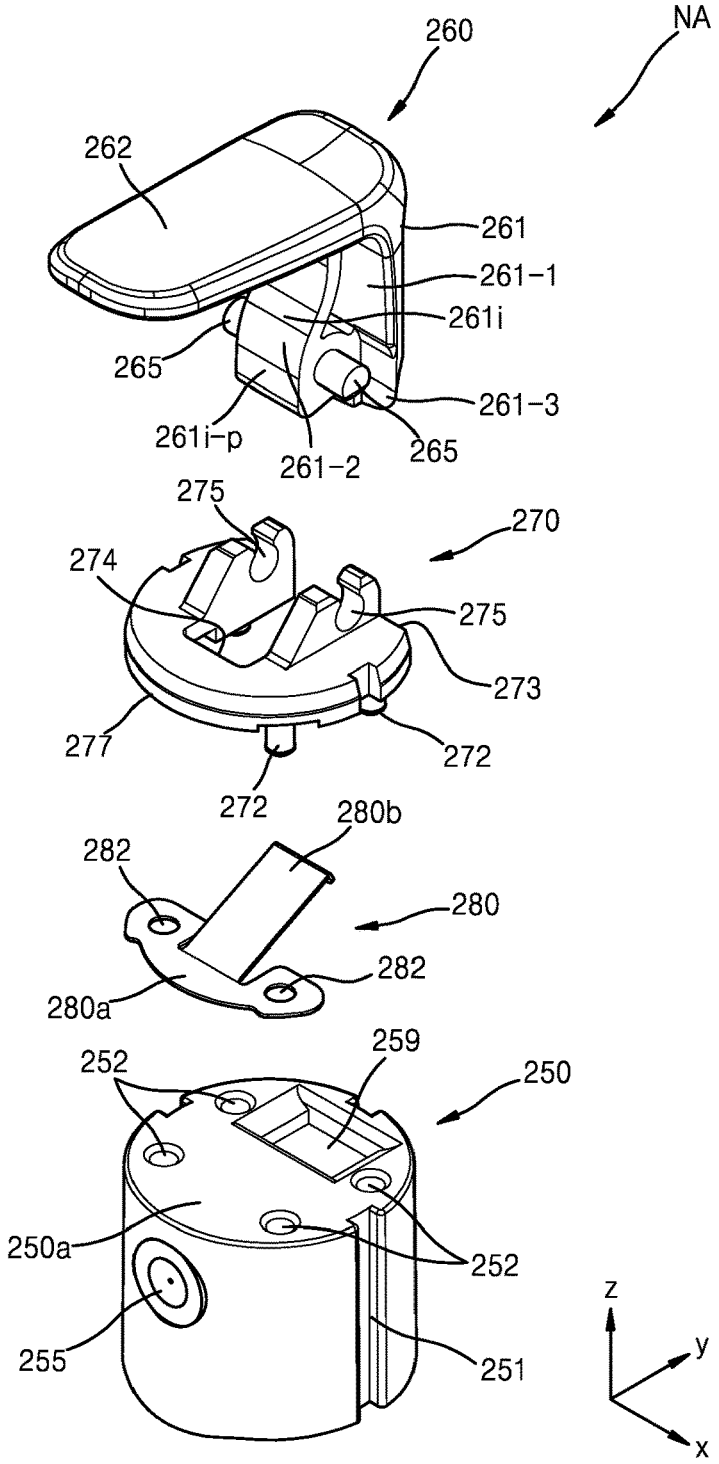
FIG. 3 is an exploded perspective view illustrating a cover assembly shown in FIG. 2.
Figure 4A:
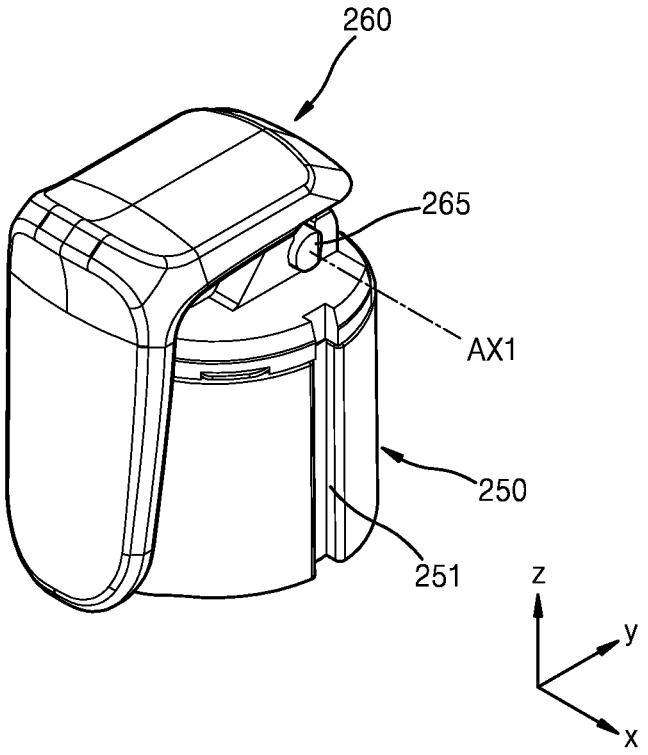
FIGS. 4A and 4B are perspective views illustrating the cover assembly shown in FIG. 3.
Figure 4B:
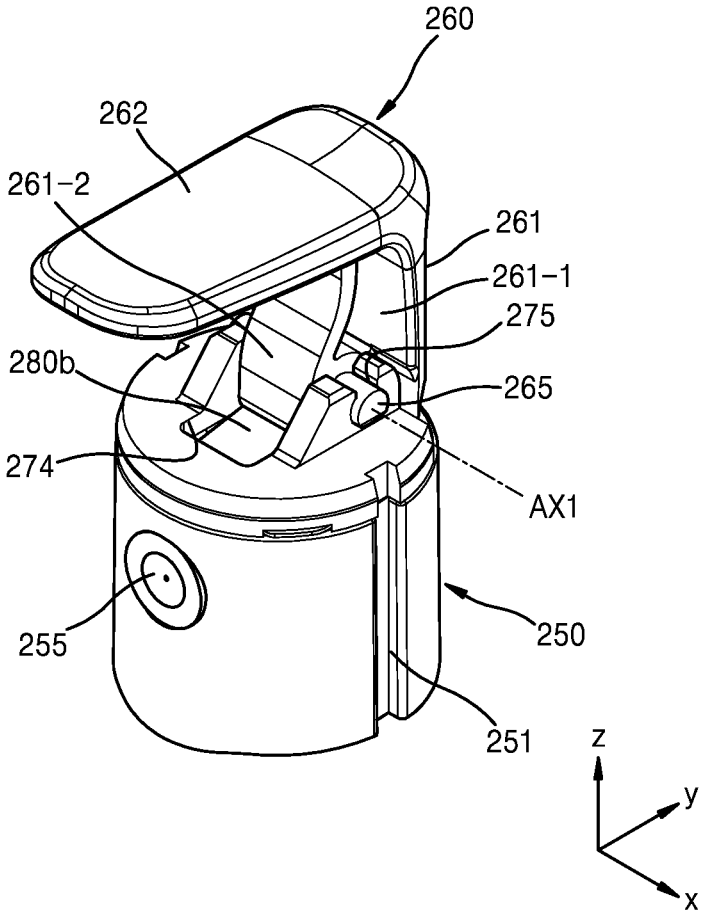

FIG. 3 is an exploded perspective view illustrating the cover assembly NA shown in FIG. 2, and FIGS. 4A and 4B are perspective views illustrating the cover assembly NA shown in FIG. 3. FIG. 4A illustrates the cover 260 when placed at a first position, and FIG. 4B illustrates the cover 260 when placed at a second position.

Referring to FIG. 3, the cover assembly NA may include an elastic portion 280. The elastic portion 280 may be placed between the head portion 250 and the cover 260, for example, between the head portion 250 and the connection cap 270 in a state in which an end portion of the elastic portion 280 is covered with the connection cap 270.

The position of a first end portion 280*a* of the elastic portion 280 on the head portion 250 may be regulated by the connection cap 270. In an embodiment, coupling protrusions 272 provided on a lower surface of the connection cap 270 are coupled to coupling holes 252 provided in an upper surface 250*a* of the head portion 250, and in this case, as some of the coupling protrusions 272 are coupled to the coupling holes 252 through holes 282 of the first end portion 280*a* of the elastic portion 280, the first end portion 280*a* of the elastic portion 280 may be fixed to the head portion 250. The first end portion 280*a* of the elastic portion 280 may be covered with a lateral portion 277 extending from a lateral edge of the connection cap 270 toward the head portion 250 and thus may not be exposed to a user. A second end portion 280*b* of the elastic portion 280 provided on an opposite side of the first end portion 280*a* may be directly in contact with the cover 260 through an opening 274 of the connection cap 270. The second end portion 280*b* of the elastic portion 280 is a free end portion that is freely movable, and when the cover 260 is rotated from the first position to the second position by a first angle (for example, about 90°) around the first axis AX1 as shown in FIGS. 4A and 4B, the second end portion 280*b* may provide elastic force to the cover 260 in a vertical direction. Owing to this, a user may feel weighty and smooth rotation of the cover 260. The second end portion 280*b* of the elastic portion 280 may be directly in contact with the cover 260 through the opening 274 of the connection cap 270. The elastic portion 280 may include a flat spring, but is not limited thereto. For example, the elastic portion 280 may include an injection-molded plastic elastic portion. If the elastic portion 280 includes an injection-molded material, the elastic portion 280 may be integrally coupled to the cover 260, the connection cap 270, or the head portion 250.

As shown in FIG. 3, the cover 260 includes the first portion 261 and the second portion 262 bent from the first portion 261, and the first portion 261 may have an average thickness greater than the average thickness of the second portion 262 such that the cover 260 may not be subjected to damage such as breakage when force is applied to the cover 260 to rotate and/or linearly move the cover 260.

In the first portion 261 of the cover 260, a region adjacent to the protrusions 265 may be thicker than the other region, and thus an inner surface 261*i* of the first portion 261 may have a curved surface. For example, a region 261*i-p* of the inner surface 261*i* of the first portion 261 adjacent to the protrusions 265 may convexly protrude toward the elastic portion 280 compared to the other region, and the convex region 261*i-p* of the inner surface 261*i* of the first portion 261 may be in contact with the second end portion 280*b* of the elastic portion 280.

In an embodiment, the first portion 261 of the cover 260 may include a first-first portion 261-1 and a first-second portion 261-2. The first-first portion 261-1 is a portion extending from an end portion of the second portion 262 and may have substantially the same width as the width of the second portion 262 in the x-axis direction. The first-second portion 261-2 is a portion protruding forward from the first-first portion 261-1 in a negative y-axis direction and may have a width less than the width of the first-first portion 261-1 in the x-axis direction. The first-second portion 261-2 may protrude from a substantially center portion of the first-first portion 261-1, and the protrusions 265 may be provided on a lower end portion of the first-second portion 261-2 facing the grooves 275. Owing to this structure, the first portion 261 may have an approximately T-shaped cross section in an X-Y plane.

The first-first portion 261-1 may be longer than the first-second portion 261-2 in the z-axis direction, and thus an end portion 261-3 of the first-first portion 261-1 may be accommodated in a recess 259 of the head portion 250 at the second position shown in FIG. 4B. To allow the end portion 261-3 of the first-first portion 261-1 to be accommodated in the recess 259 at the second position, a flat surface 273 may be provided at a corresponding position of the connection cap 270.

Figure 5:
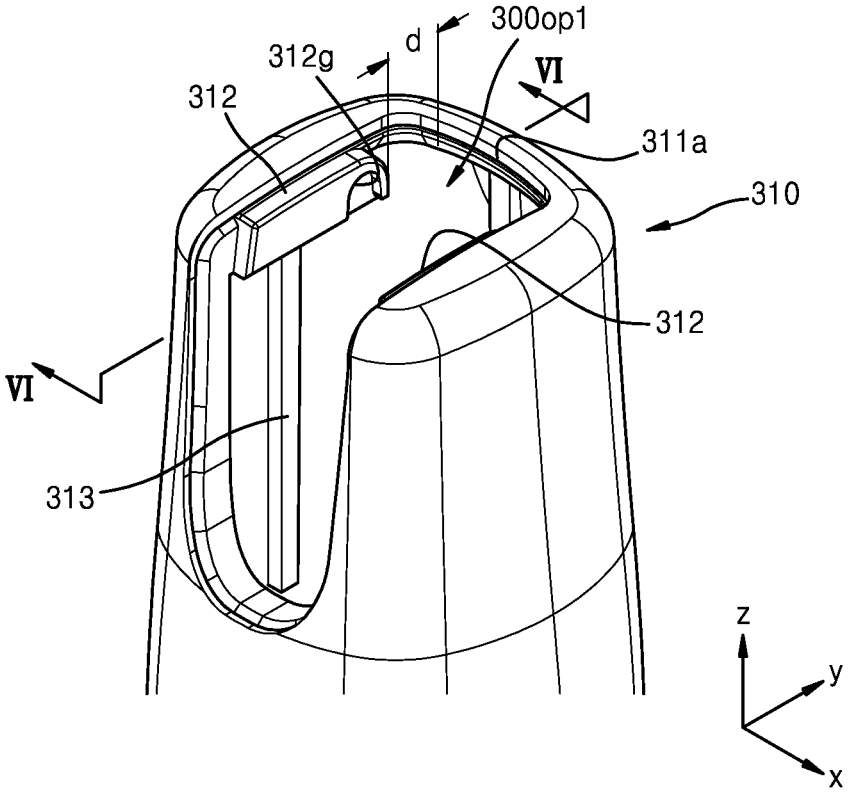
FIG. 5 is a perspective view illustrating a portion of an upper case shown in FIG. 1.
Figure 6:
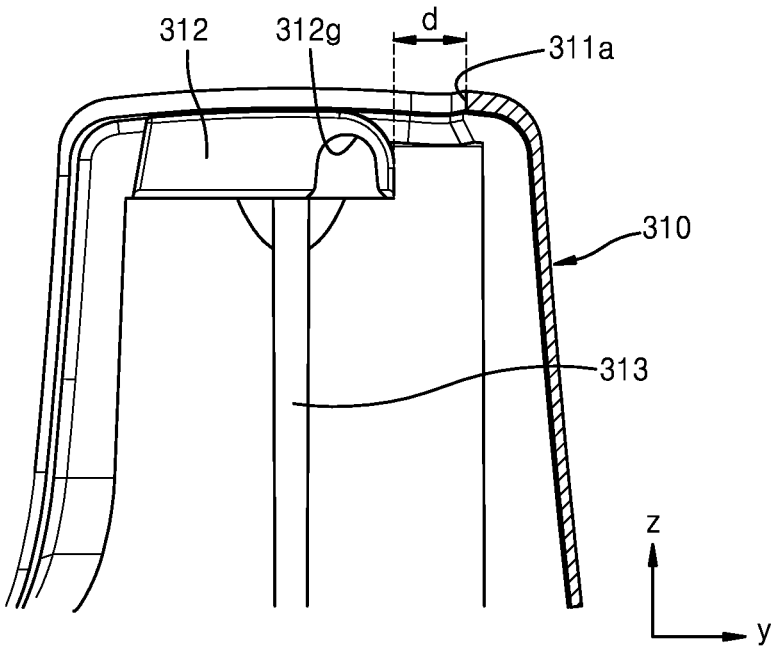
FIG. 6 is a cross-sectional view taken along line VI-VI of FIG. 5.
Figure 7:
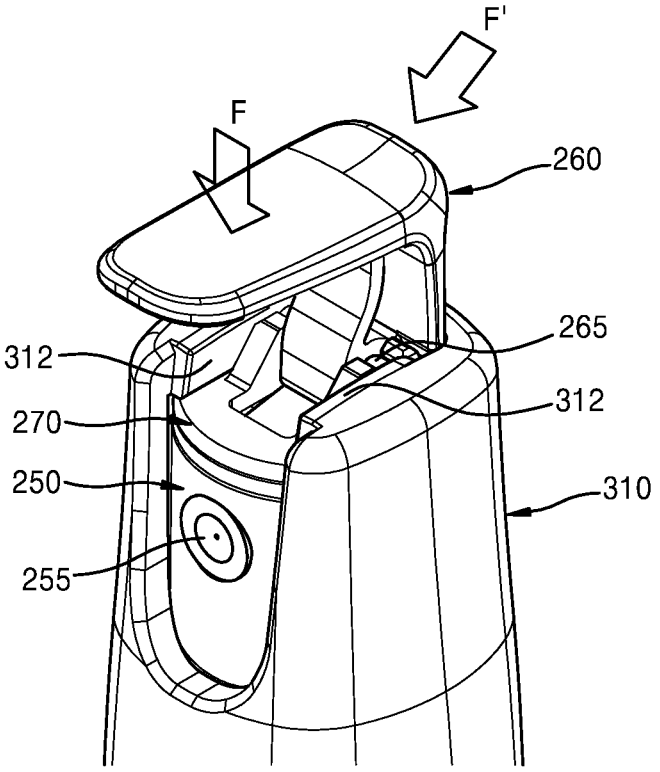
FIG. 7 is a perspective view illustrating the upper case and the cover assembly at a second position.

FIG. 5 is a perspective view illustrating a portion of the upper case 310 shown in FIG. 1, FIG. 6 is a cross-sectional view taken along ling VI-VI of FIG. 5, and FIG. 7 is a perspective view illustrating the upper case 310 and the cover assembly NA at the second position.

Referring to FIGS. 5 and 6, the upper case 310 may include stoppage portions 312*g*. The stoppage portions 312*g* have a recess shape having a given depth, and when the cover 260 is at the second position as shown in FIG. 4B, the stoppage portions 312*g* may receive the protrusions 265 provided on the cover 260. When the cover 260 is rotated from the first position to the second position as described above, the cover 260 may be unexpectedly separated or displaced from the connection cap 270 by force applied from the elastic portion 280, and to prevent this, the upper case 310 may include the stoppage portions 312*g*. For example, in an embodiment, when upper sides of the grooves 275 of the connection cap 270 have an opened C-shape (refer to FIG. 4B) for coupling with the protrusions 265 of the cover 260, the direction of force applied from the elastic portion 280 to the cover 260 is substantially parallel to the upper sides of the grooves 275, and thus the cover 260 may be separated and displaced from the connection cap 270 through the upper sides of the grooves 275. However, this may be prevented because the stoppage portions 312*g* of the upper case 310 suppress displacement of the protrusions 265.

The upper case 310 may include a pair of ribs (or protrusions) 312 arranged parallel to each other with the first opening region 300*op*1 being therebetween. For example, the pair of ribs 312 may be arranged on both lateral edges of the first opening region 300*op*1. A first end portion of each of the ribs 312 may be at a first distance (d) from an inner wall 311*a* of the upper case 310 defining the first opening region 300*op*1. Therefore, a space defined by the ribs 312 and the inner wall 311*a* of the upper case 310 may be a T-shaped opening in a x-y plane. The space, defined by the ribs 312 and the inner wall 311*a* of the upper case 310, corresponds to a space occupied by a T-shaped structure of the first portion 261 of the cover 260, for example the first-first portion 261-1 of the cover 260, when the cover 260 is at the second position, and the first-first portion 261-1 is vertically moved between the ribs 312 and the inner wall 311*a* of the upper case 310. For example, as shown in FIG. 7, the cover 260 may be vertically moved by force F applied to the cover 260. If force F' is applied to the cover 260 in a direction oblique to a linear movement direction (z-axis direction) of the cover 260, the cover 260 may be reversely rotated to the first position before the cover 260 is vertically moved and/or the content is discharged. However, owing to the above-described ribs 312, the cover 260 may not be unexpectedly closed, that is, may not be reversely rotated from the second position to the first position. In addition, the ribs 312 may function as stoppers when the cover 260 is closed. For example, when the cover 260 is closed to cover the opening 300*op* after the content is discharged, the ribs 312 arranged on both lateral sides of the first opening region 300*op*1 of the upper case 310 may prevent the cover 260 from being excessively rotated to an inner region through the opening 300*op*.

Referring to FIGS. 5 to 7, the ribs 312 extend to a given length along the lateral sides of the first opening region 300*op*1. However, the ribs 312 may be shorter than the length shown in FIGS. 5 to 7.

Figure 8A:
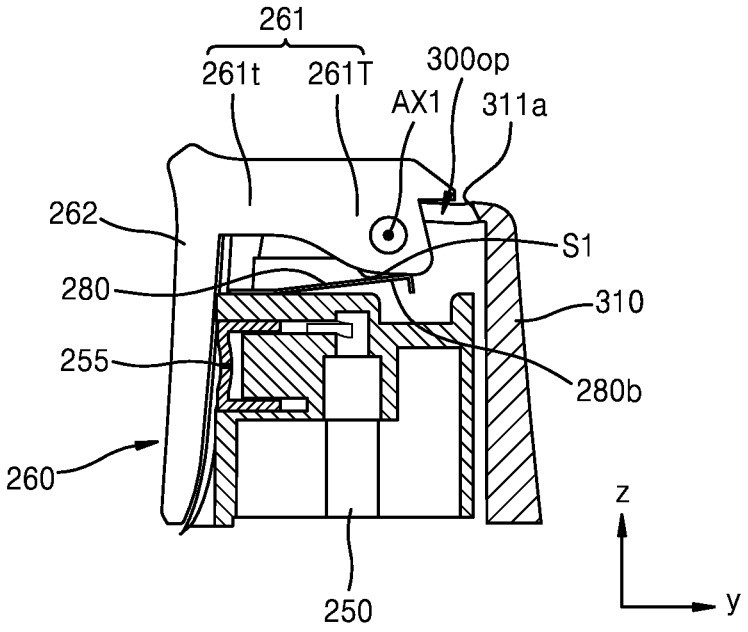
FIGS. 8A to 8C are cross-sectional views illustrating rotation of a cover with respect to a case.
Figure 8B:
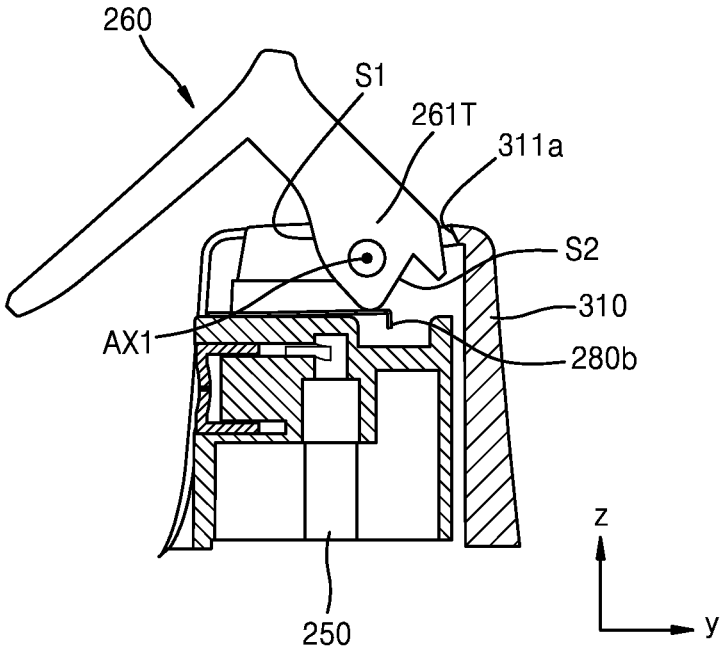
Figure 8C:
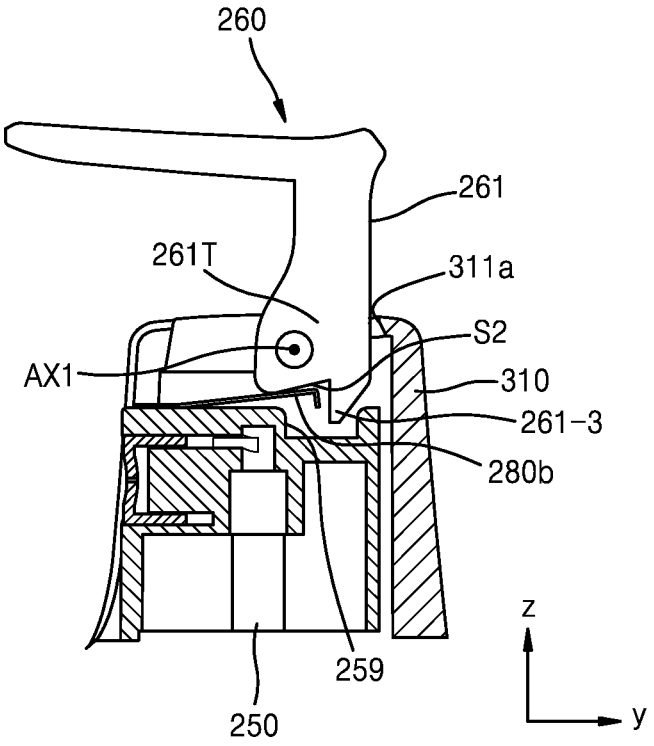
Figure 8D:
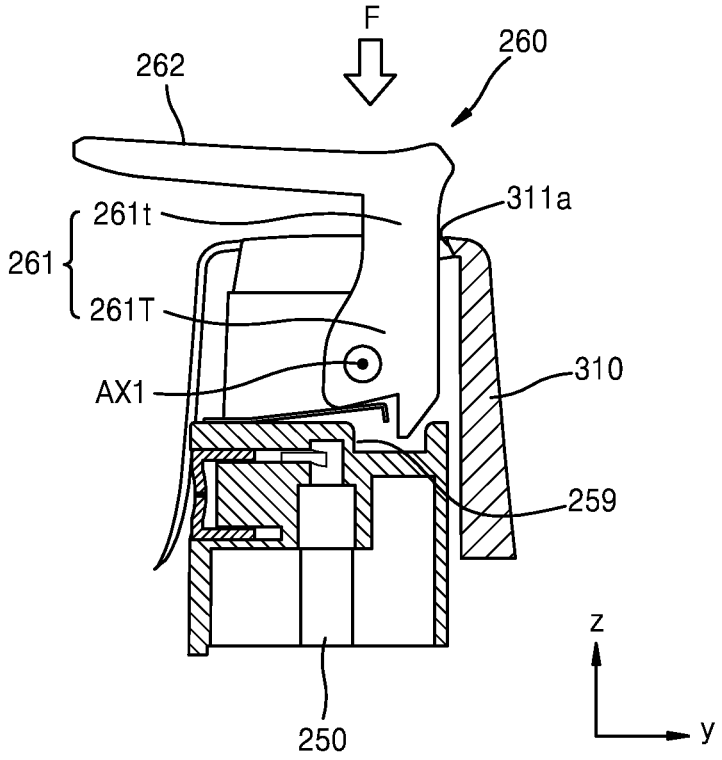
FIG. 8D is a cross-sectional view illustrating linear movement of the cover with respect to the case.

FIGS. 8A to 8C are cross-sectional views illustrating rotation of the cover 260 with respect to the case 300, and FIG. 8D is a cross-sectional view illustrating linear movement of the cover 260 with respect to the case 300. FIG. 8A may illustrate the first position of the cover 260, FIG. 8C may illustrate the second position of the cover 260, and FIG. 8D may illustrate a third position of the cover 260.[41]

As shown in FIG. 8A, the cover 260 covers the opening 300*op* of the upper case 310 at the first position. Since the discharge hole 255 of the head portion 250 is covered with the second portion 262 of the cover 260 and not exposed to the outside, the discharge hole 255 may not be contaminated.

When a user applies force to the cover 260, for example, using his/her hand to open the cover 260, the cover 260 is rotated around the first axis AX1 to the second position as shown in FIGS. 8B and 8C. When the cover 260 is moved from the first position to the second position, the elastic portion 280 provided under the cover 260 applies upward force to the cover 260. In an embodiment, the second end portion 280*b* of the elastic portion 280 may be in contact with a first inner surface S1 of a thick portion 261T of the first portion 261 of the cover 260 at the first position and may be in contact with a second inner surface S2 of the first portion 261 at the second position (refer to FIG. 8C) to place the cover 260 at the second position. Since an end of the second end portion 280*b* is bent downward, when the second end portion 280*b* undergoes a transition from contact with the first inner surface S1 to contact with the second inner surface S2, the second end portion 280*b* may not be unexpectedly hooked on the first and second inner surfaces S1 and S2 of the cover 260. Here, the second inner surface S2 is connected to the first inner surface S1 of the thick portion 261T and extends in a direction crossing the first inner surface S1. In addition, as shown in FIG. 8C, the second end portion 280*b* of the elastic portion 280 may support the cover 260 at a position under the second inner surface S2 of the first portion 261 of the cover 260, and thus the cover 260 may not be unexpectedly rotated in a reverse direction from the second position to the first position unless an external force equal to or greater than a given value is applied to the cover 260.

Owing to structures such as the ribs 312 and the composite structure of the elastic portion 280 providing elastic force to the cover 260, the cover 260 is not easily closed or opened unless a force equal to or greater than a give value is applied. Thus, the cover 260 may not be unexpectedly opened or closed, and when a force equal to or greater than the given value is applied to the cover 260, the cover 260 may be easily opened or closed.

Thereafter, as shown in FIG. 8D, when force F is applied to the cover 260, the cover 260 is moved downward in a direction perpendicular to the first axis AX1, and thus the head portion 250 located under the cover 260 is also moved downward, thereby discharging the content through the discharge hole 255. To intactly transmit force to the head portion 250 when the cover 260 is linearly moved, the head portion 250 may include the recess 259 in an upper portion thereof to receive an end of the cover 260, for example, the end portion 261-3 of the first-first portion 261-1 of the cover 260.

As the cover 260, the connection cap 270, the elastic portion 280, and the head portion 250 mechanically connected to each other are moved together by force F, the first axis AX1 of the cover 260 may also be linearly moved together with the cover 260.

When pumping action is made as the cover 260, the connection cap 270, the elastic portion 280, and the head portion 250 are moved together by the force F, a gap may be formed between the cover 260 and the inner wall 311*a* of the upper case 310. In this case, foreign substances may be introduced through the gap during the pumping action, or some of liquid discharged through the discharge hole 255 may leak through the gap. In an embodiment, owing to the recess 259 and the end portion 261-3 of the first-first portion 261-1 accommodated in the recess 259, introduction of foreign substances and leakage of discharged liquid may be prevented during the pumping action, and aesthetic inconvenience may be removed.

The spray structure 10 having the above-described configuration for a portable atomizer makes it possible for a user to check the spraying direction in which the content is discharged only by feeling in his/her hand without having to check the spraying direction with the naked eye. For example, as soon as a user takes the spray structure 10 out of his/her pocket, the user may turn the cover 260 to spray the content in an intended direction. In addition, a user may open and close the cover 260 only with one hand.

Figure 9:
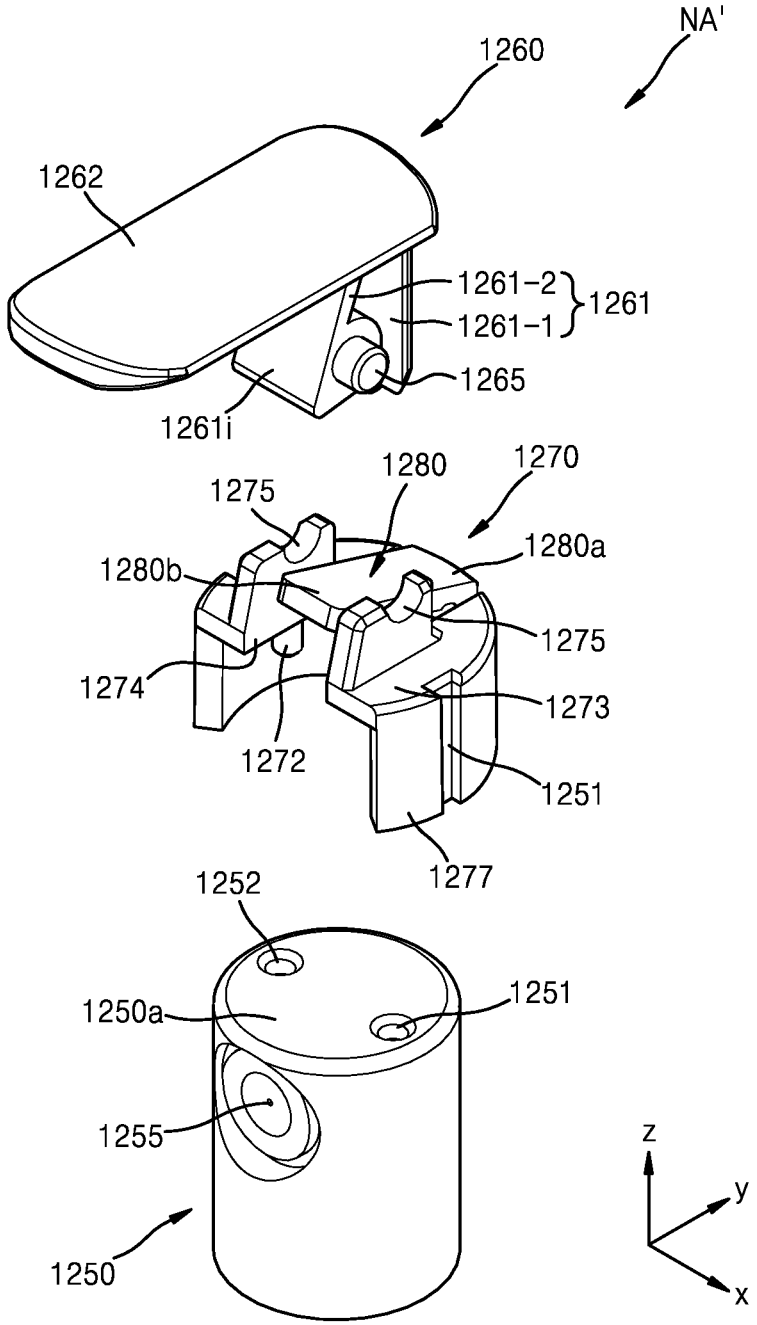
FIG. 9 is an exploded perspective view illustrating a cover assembly according to another embodiment of the present disclosure.

FIG. 9 is an exploded perspective view illustrating a cover assembly NA' according to another embodiment of the present disclosure.

Referring to FIG. 9, the cover assembly NA' includes an elastic portion 1280 and a connection cap 1270 that are provided in one piece. The elastic portion 1280 and the connection cap 1270 may be provided in one piece by an injection molding method using the same mold. The elastic portion 1280 may be a portion of the connection cap 1270 and may include the same material (for example, a plastic material) as that included in the connection cap 1270.

The connection cap 1270 may include a flat surface (or an upper surface) 1273 corresponding to an upper surface of a head portion 1250, and a lateral portion 1277 perpendicularly bent from the flat surface 1273 to cover a lateral surface of the head portion 1250. The connection cap 1270 may include an opened region 1274 provided by removing a region of the connection cap 1270 in order not to block a discharge hole 1255 of the head portion 1250. The lateral portion 1277 of the connection cap 1270 may include grooves 1251 corresponding to the protrusions 313 (refer to FIG. 5) provided on the inner surface of the case 300.

As coupling protrusions 1272 provided on a lower surface of the connection cap 1270 are coupled to coupling holes 1252 provided in an upper surface 1250*a* of the head portion 1250, the position of the connection cap 1270 may be fixed with respect to the head portion 1250. In FIG. 9, a pair of coupling protrusions 1272 and a pair of coupling holes 1252 are illustrated.

The elastic portion 1280 may obliquely extend at an angle from an edge of the connection cap 1270. For example, a first end portion 1280*a* of the elastic portion 1280 is a fixed end provided in one piece with an edge connecting the upper surface 1273 and the lateral portion 1277 of the connection cap 1270 to each other. A second end portion 1280*b* of the elastic portion 1280 provided on an opposite side of the first end portion 1280*a* of the elastic portion 1280 is a free end that is freely movable. Unlike the second end portion 280*b* of the elastic portion 280 extending (forward) in the negative y-axis direction toward the discharge hole 255 as shown in FIG. 3, the second end portion 1280*b* of the elastic portion 1280 shown in FIG. 9 extends (backward) in the y-axis direction away from the discharge hole 1255. Unlike in FIG. 9, in another embodiment, the second end portion 1280*b* of the elastic portion 1280 may extend toward the discharge hole 1255 like in FIG. 3.

When a cover 1260 is rotated from a first position to a second position by a first angle (for example, about 90°) around a first axis AX1 as described with reference to FIGS. 4A and 4B, the second end portion 1280*b* of the elastic portion 1280 may provide elastic force to the cover 1260 in a vertical direction. Owing to this, a user may feel weighty and smooth rotation of the cover 1260. The second end portion 1280*b* of the elastic portion 1280 may directly be in contact with the cover 1260.

The cover 1260 is coupled to the connection cap 1270 using grooves 1275 and protrusions 1265. FIG. 9 illustrates that the connection cap 1270 includes a pair of grooves 1275, and the cover 1260 includes protrusions 1265 configured to be coupled to the grooves 1275.

As shown in FIG. 9, the cover 1260 may include a first portion 1261 and a second portion 1262 bent with respect to the first portion 1261. The first portion 1261 may have an average thickness greater than the average thickness of the second portion 1262, and thus when force is applied to the cover 1260 to rotate and/or linearly move the cover 1260, the cover 1260 may not be broken or damaged.

A portion of the first portion 1261 of the cover 1260 adjacent to the protrusions 1265 may be thicker than the other portion. An inner surface 1261*i* of the first portion 1261 may be flat. For example, a region of the inner surface 1261*i* of the first portion 1261 adjacent to the protrusions 1265 may form a thicker portion than the other region.

In an embodiment, the first portion 1261 of the cover 1260 may include a first-first portion 1261-1 and a first-second portion 1261-2. The first-first portion 1261-1 may be a portion extending from an end portion of the second portion 1262 and may be exposed to the outside. The first-first portion 1261-1 may have substantially the same width as the width of the second portion 1262 in the x-axis direction. The first-second portion 1261-2 protrudes forward from the first-first portion 261-1 in the negative y-axis direction and may have a width less than the width of the first-first portion 1261-1 in the x-axis direction. The first-second portion 1261-2 may protrude from a substantially center portion of the first-first portion 1261-1, and the protrusions 1265 may be provided on a lower end portion of the first-second portion 1261-2 facing the grooves 1275. Owing to this structure, the first portion 1261 may have an approximately T-shaped cross section in an x-y plane. The first-first portion 1261-1 may be longer than the first-second portion 1261-2 in the z-axis direction.

Figure 10A:
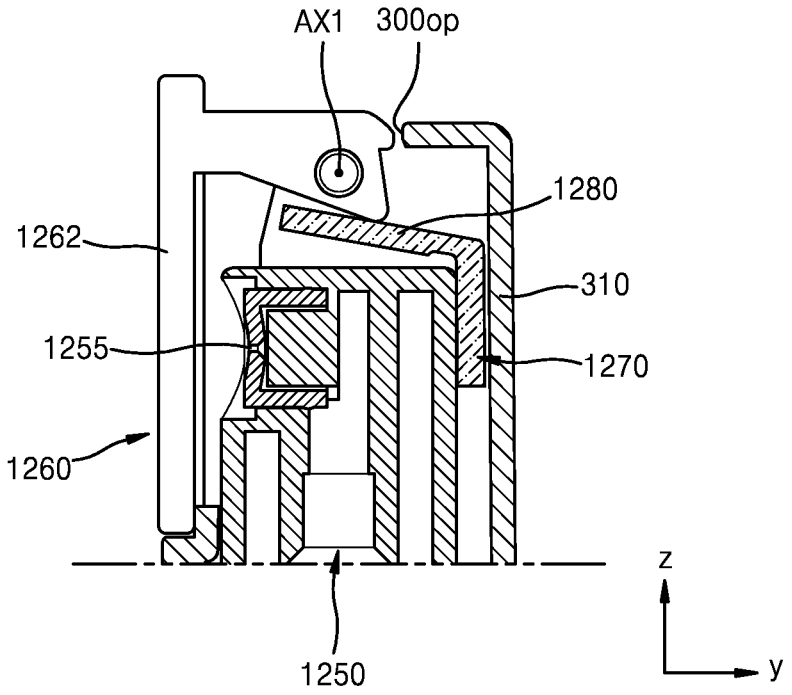
FIGS. 10A to 10C are cross-sectional views illustrating rotation of a cover with respect to the case.
Figure 10B:
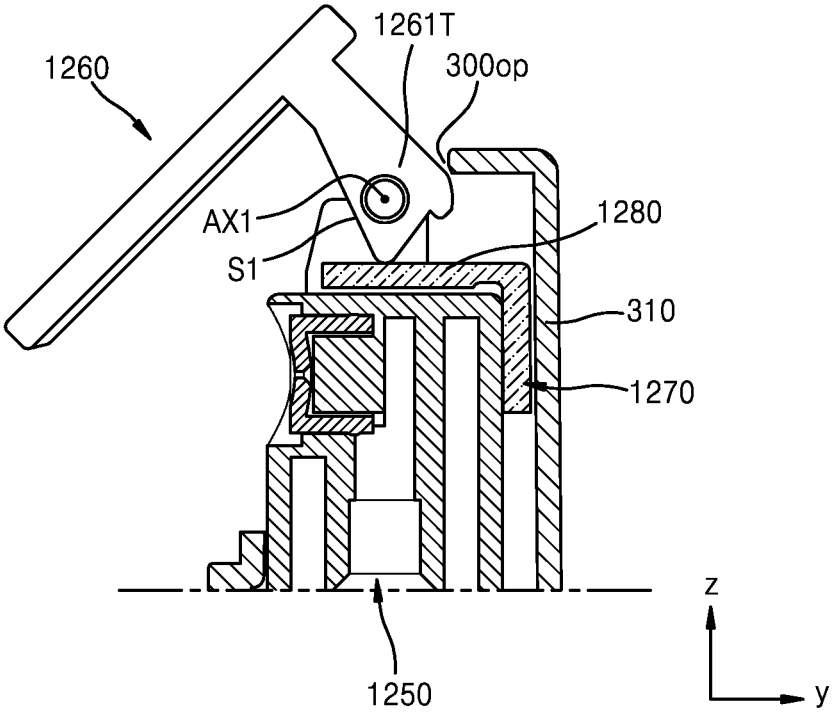
Figure 10C:
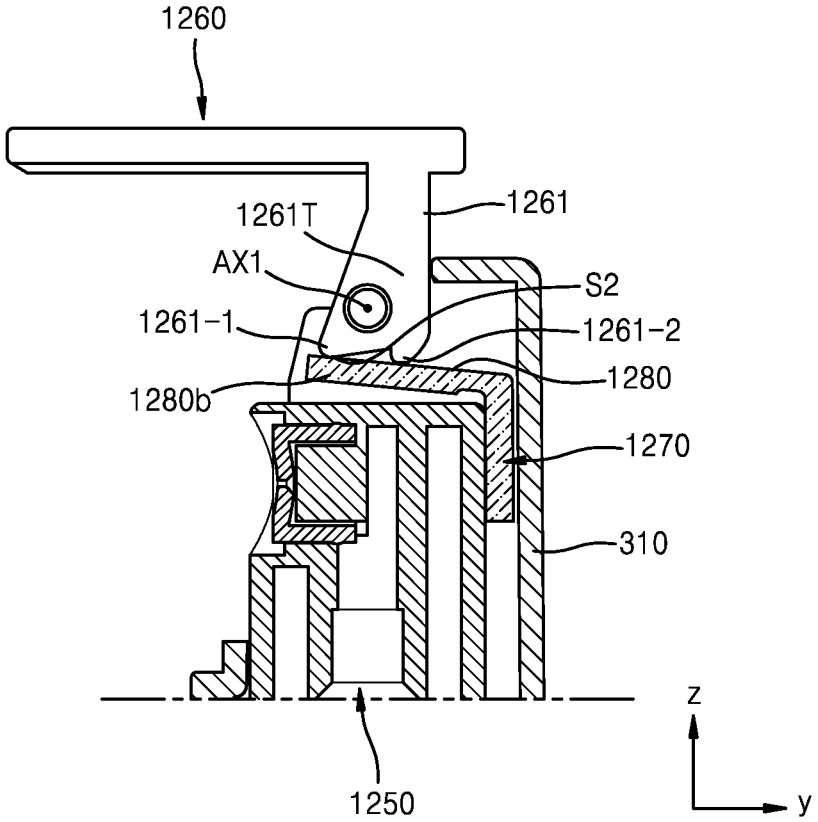

FIGS. 10A to 10C are cross-sectional views illustrating rotation of the cover 1260 with respect to the case 300, and FIG. 8D is a cross-sectional view illustrating linear movement of the cover 1260 with respect to the case 300. FIG. 10A may illustrate the first position of the cover 1260, FIG. 10C may illustrate the second position of the cover 1260, and FIG. 10D may illustrate a third position of the cover 1260.

As shown in FIG. 10A, the cover 1260 covers the opening 300*op* of the upper case 310 at a first position. Since the discharge hole 1255 of the head portion 1250 is covered with the second portion 1262 of the cover 1260 and not exposed to the outside, the discharge hole 1255 may not be contaminated.

When a user applies force to the cover 1260, for example, using his/her hand to turn the cover 1260, the cover 1260 is rotated about the first axis AX1 from the first position to the second position as shown in FIGS. 10A, 10B and 10C. When the cover 1260 is moved from the first position to the second position, the elastic portion 1280 of the connection cap 1270 provided under the cover 1260 applies upward force to the cover 1260. In an embodiment, the second end portion 1280*b* of the elastic portion 1280 may be in contact with a first inner surface S1 of a thick portion 1261T of the first portion 1261 of the cover 1260 at the first position and may be in contact with a second inner surface S2 of the first portion 1261 at the second position (refer to FIG. 10C) to place the cover 1260 at the second position. Here, the second inner surface S2 is connected to the first inner surface S1 of the thick portion 1261T and extends in a direction crossing the first inner surface S1. For example, an end portion of the first-first portion 1261-1 and an end portion of the first-second portion 1261-2 of the first portion 1261 may be in contact with an upper surface of the elastic portion 1280 at the second position.

In addition, as shown in FIG. 10C, the second end portion 1280*b* of the elastic portion 1280 may support the cover 1260 at a position under the second inner surface S2 of the first portion 1261 of the cover 1260, and thus the cover 1260 may not be unexpectedly rotated in a reverse direction from the second position to the first position unless an external force equal to or greater than a given value is applied to the cover 1260.

Owing to structures such as the ribs 312 and the composite structure of the elastic portion 1280 providing elastic force to the cover 1260 described in FIGS. 5 to 7, the cover 1260 is not easily closed or opened unless a force equal to or greater than a give value is applied. Thus, the cover 1260 may not be unexpectedly opened or closed, and when a force equal to or greater than the given value is applied to the cover 1260, the cover 1260 may be easily opened or closed.

Figure 10D:
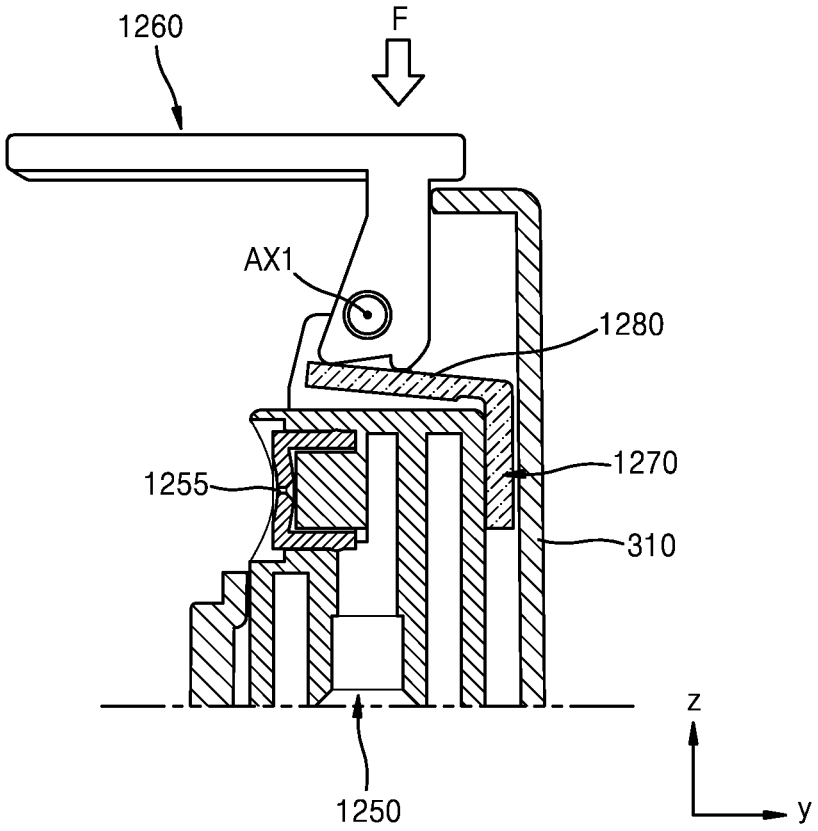
FIG. 10D is a cross-sectional view illustrating linear movement of the cover with respect to the case.

Thereafter, as shown in FIG. 10D, when force F is applied to the cover 1260, the cover 1260 is moved downward in a direction perpendicular to the first axis AX1, and thus the head portion 1250 located under the cover 1260 is also moved downward, thereby discharging the content through the discharge hole 1255. As described above, while an end portion of the first portion 1261 of the cover 1260 makes direct contact with an upper surface of the head portion 1250, force F applied to the cover 1260 may be intactly transmitted to the head portion 1250. As the cover 1260, the connection cap 1270 including the elastic portion 280, and the head portion 1250 that are mechanically connected to each other are moved together by the force F, the first axis AX1 of the cover 1260 may also be linearly moved together with the cover 1260.

The spray structure 10 having the above-described configuration for a portable atomizer makes it possible for a user to check the spraying direction in which the content is discharged only by feeling in his/her hand without having to check the spraying direction with the naked eye. For example, as soon as a user takes the spray structure 10 out of his/her pocket, the user may turn the cover 1260 to spray the content in an intended direction. In addition, a user may open and close the cover 1260 only with one hand.

As a comparative example, when a discharge hole is exposed without a cap, contaminants such as dust may mix with contents inside or around the discharge hole, and thus the discharge hole may be contaminated. If an additional cap is provided to a container, it is inconvenient to additionally manage the cap. However, as described above, according to the one or more of the above embodiments, the discharge hole may be exposed by opening the cover in a one touch manner, and the head portion may be stably pressed using the cover such that a user may easily perform a pressing action to spray contents. These effects are examples, and other effects of the embodiments will be clearly understood through the above descriptions of the embodiments.

It should be understood that embodiments described herein should be considered in a descriptive sense only and not for purposes of limitation. Descriptions of features or aspects within each embodiment should typically be considered as available for other similar features or aspects in other embodiments.

While one or more embodiments have been described with reference to the figures, it will be understood by those of ordinary skill in the art that various changes in form and details may be made therein without departing from the spirit and scope of the disclosure as defined by the following claims.

What is claimed is:

1. A spray structure for a portable atomizer, the spray structure comprising:

a case comprising an opening;

a cover exposed through the opening of the case;

a head portion placed in the case and coupled to the cover, the head portion comprising a discharge hole;

an elastic portion between the head portion and the cover; and a connection cap connected to a first end portion of the elastic portion at a position between the head portion and the cover, wherein the cover is configured to be rotatable about a first axis by a first angle above the head portion to expose the discharge hole through the opening of the case and to be linearly moved in a second direction perpendicular to the first axis in a state in which the discharge hole is exposed, and when the cover is rotated by the first angle, a second end portion of the elastic portion provides force to the cover through an opening of the connection cap.

2. The spray structure of claim 1, wherein the opening of the case comprises a T-shaped opening, and the cover comprises a first portion having a T-shaped structure for being guided along the T-shaped opening in a state in which the discharge hole is exposed.

3. The spray structure of claim 1, further comprising an assembly of a protrusion and a groove that are provided between the head portion and the case and move relative to each other while being engaged with each other.

4. A spray structure for a portable atomizer, the spray structure comprising:

a case comprising a first opening region formed in an end thereof and a contiguous second opening region in a lateral surface thereof, wherein the first opening region has a T-shaped portion with a first wider section forming an end of the first opening region and an adjacent second narrower section:

a head portion positioned in the case and comprising a discharge hole; and a cover engageable with an upper portion of the head portion and movably coupled to the case to cover and uncover the second opening region, wherein the cover is configured to be rotatable around a first axis from a first position to a second position to expose the discharge hole through the second opening region and configured to press the head portion while being linearly moved from the second position in a direction perpendicular to the first axis, wherein the first axis extends through the second narrower section of the first opening region, and the cover comprises a first portion having a T-shaped structure so that the cover is guided from the second position and through the T-shaped portion of the first opening region.

5. The spray structure of claim 4, wherein the case further comprises a rib provided around the first opening region to define the T shaped portion with the second narrower section and the first wider section, the rib being spaced apart from an inner wall of the case, wherein the first portion comprises a first-first portion placed between the rib and the inner wall of the case at the second position.

* * * * *